US008403525B2

(12) United States Patent
Prosey

(10) Patent No.: US 8,403,525 B2
(45) **Date of Patent: *Mar. 26, 2013**

(54) LIGHTING SYSTEM FOR VEHICLE MAINTENANCE PLATFORM

(76) Inventor: Joseph Prosey, Benton, PA (US)

( * ) Notice: Subject to any disclaimer, the term of this patent is extended or adjusted under 35 U.S.C. 154(b) by 202 days.

This patent is subject to a terminal disclaimer.

(21) Appl. No.: 12/705,824

(22) Filed: Feb. 15, 2010

(65) Prior Publication Data

US 2011/0063821 A1 Mar. 17, 2011

Related U.S. Application Data

(63) Continuation-in-part of application No. 12/559,534, filed on Sep. 15, 2009.

(51) Int. Cl.
*F21V 33/00* (2006.01)

(52) U.S. Cl. ..... 362/234; 362/183; 280/32.6

(58) Field of Classification Search ..... 362/183, 362/234; 280/32.6

See application file for complete search history.

(56) References Cited

U.S. PATENT DOCUMENTS

| | | | | |
|---|---|---|---|---|
| 2,291,094 | A * | 7/1942 | McCarthy | 362/459 |
| 4,698,731 | A * | 10/1987 | Johns, Sr. | 362/486 |
| 4,721,316 | A * | 1/1988 | Whiteside | 280/32.6 |
| 4,986,558 | A * | 1/1991 | Morris | 280/32.6 |
| 5,494,305 | A * | 2/1996 | Chen | 280/32.6 |
| 6,238,069 | B1 * | 5/2001 | Miles | 362/486 |
| 7,032,908 | B2 * | 4/2006 | Melvin | 280/32.6 |
| 7,815,356 | B2 * | 10/2010 | Lutz et al. | 362/577 |
| 2002/0109991 | A1 * | 8/2002 | Alsup | 362/253 |
| 2006/0028819 | A1 * | 2/2006 | Shankland et al. | 362/253 |

* cited by examiner

*Primary Examiner* — Mary McManmon
*Assistant Examiner* — Mary Zettl
(74) *Attorney, Agent, or Firm* — Aidenbaum Schloff and Bloom PLLC; Jay Schloff

(57) ABSTRACT

A lighting system for a vehicle maintenance platform includes a support frame structure, a plurality of light sources and a rechargeable power source. The plurality of light sources is disposed on or within the frame structure and is configured to illuminate a target region underneath a vehicle. The rechargeable power source is contained within the frame structure and is electrically connected to the plurality of light sources. The rechargeable power source provides electrical power to the plurality of light sources. A vehicle maintenance apparatus including the lighting system and the vehicle maintenance platform is also provided.

16 Claims, 4 Drawing Sheets

LIGHTING SYSTEM FOR VEHICLE MAINTENANCE PLATFORM

CROSS REFERENCE TO RELATED APPLICATIONS

The present disclosure is a continuation-in-part of U.S. patent application Ser. No. 12/559,534, filed on Sep. 15, 2009, the disclosure of which is incorporated by reference.

FIELD OF THE DISCLOSURE

The present disclosure relates generally to lighting systems, and more particularly, to a lighting system for vehicle maintenance platforms that are utilized for maintenance activities underneath vehicles.

BACKGROUND OF THE DISCLOSURE

It is common for a vehicle mechanic to use a vehicle maintenance platform (hereinafter referred to as 'platform') for performing various maintenance activities underneath a vehicle. For example, the vehicle mechanic (hereinafter referred to as 'mechanic') may utilize the platform, such as a creeper, to access a bottom portion of the vehicle to perform various maintenance activities by sliding/rolling the platform underneath the vehicle. Generally, the platform includes a body support platform to support mechanic's body and a wheel assembly for facilitating movement of the platform from one place to another. The mechanic may lie on the body support platform and roll under the vehicle using the wheel assembly of the platform, while the vehicle is held at a particular height above the ground level using a hydraulic lift, a mechanical jack, and the like.

Generally, while the mechanic is positioned underneath the vehicle, there is a lack of ample light for the mechanic to properly see and perform work on the bottom portion (i.e., the underside) of the vehicle. This is primarily due to the fact that various components of the vehicle and the mechanic's body may block the light coming from a light source, such as garage lighting. Such blockage may cause a dimly lit region to be formed in the bottom portion of the vehicle, thereby inconveniencing the mechanic that is attempting to perform the maintenance activities.

A few techniques known in the art address the above problem of insufficient light in the bottom portion of the vehicle. In one such technique, the mechanic utilizes a portable light source. Typically, the mechanic positions the portable light source near the platform such that the portable light source illuminates the bottom portion of the vehicle. In some cases, the mechanic holds the portable light source in his/her hand at a desired position, or he/she may keep it on the ground near the platform. Alternatively, the mechanic may also hang the portable light source upon any suitable component of the bottom portion of the vehicle by using a hook (or other fastener) incorporated on the light source or by an electrical cord that is utilized to provide electrical power to the portable light source from a conventional wall socket. The electrical cord is connected at one end to the portable light source and to the wall socket at other end, for providing electrical power to the portable light source from the conventional wall socket.

Such a portable light source has various drawbacks associated therewith. For example, the portable light source requires a connection (and proximity) to a conventional wall socket for obtaining electrical power to power itself. However, sometimes an electrical outlet such as the conventional wall socket is not easily accessible or not available at all near the vehicle. In such cases, it becomes very cumbersome for the mechanic to perform maintenance activities in and around the bottom portion of the vehicle. Further, it is inconvenient for the mechanic to hold the portable light source in his/her hand while performing the maintenance activities. Also, holding the portable light source with one hand may be tiresome and also may reduce the efficiency of the mechanic, as he/she will only be able to perform the maintenance activities with one hand. Further, when the mechanic keeps the portable light on the ground, the electrical cord and the portable light itself cause obstructions in movement of the platform. Particularly, the electrical cord and the portable light cause obstructions in the rolling of the wheels of the platform.

SUMMARY

In view of the foregoing disadvantages inherent in the prior art, the general purpose of the present disclosure is to provide a vehicle maintenance platform with a lighting system, configured to include all the advantages of the prior art, and to overcome the drawbacks inherent therein.

Accordingly, an object of the present disclosure is to provide a vehicle maintenance platform with a lighting system, where the lighting system avoids any electrical power requirement from an external wall socket or source.

Another object of the present disclosure is to provide a vehicle maintenance platform with a lighting system that is convenient to a mechanic in performing maintenance activities underneath a vehicle.

Yet another object of the present disclosure is to provide a vehicle maintenance platform with a lighting system that may be conveniently moved from one place to another without undue hindrance.

In light of the above objects, in one aspect of the present disclosure, a vehicle maintenance platform with a lighting system is provided. The platform includes a support frame structure, a plurality of light sources and a rechargeable power source. The plurality of light sources is disposed on the support frame structure. The plurality of light sources is configured to illuminate a target region underneath the vehicle. The rechargeable power source is positioned on the frame structure. The rechargeable power source powers the plurality of light sources. The plurality of light sources is capable of emitting light to illuminate the target region underneath the vehicle while a mechanic performs maintenance activities on the vehicle.

In another aspect of the present disclosure, a vehicle maintenance apparatus is disclosed. The vehicle maintenance apparatus includes a vehicle maintenance platform with a lighting system disposed thereon. The vehicle maintenance platform includes a support frame structure, a plurality of wheels and a body support member. The lighting system includes a plurality of light sources and a rechargeable power source. The plurality of wheels is attached to the support frame structure. The plurality of wheels is configured to facilitate rolling of the support frame structure. The body support member is positioned on the support frame structure. The body support member is configured to support a mechanic's body thereon. The plurality of light sources is disposed on the support frame structure. The plurality of light sources is configured to illuminate a target region underneath a vehicle. Further, the rechargeable power source is coupled to the support frame structure. The rechargeable power source is electrically connected to the plurality of light sources. The rechargeable power source powers the plurality of light sources. The plurality of light source is capable of emitting light to illuminate the target region underneath the vehicle while the maintenance activities.

These together with other aspects of the present disclosure, along with the various features of novelty that characterize the present disclosure, is pointed out with particularity in the claims annexed hereto and forms a part of this present disclosure. For a better understanding of the present disclosure, its operating advantages, and the specific objects attained by its uses, reference should be made to the accompanying drawing and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

The exemplary embodiments described herein detail for illustrative purposes are subject to many variations in composition, structure, and design. It should be emphasized, however, that the present disclosure is not limited to a vehicle maintenance platform with lighting system or a vehicle maintenance apparatus, as shown and described. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

Unless limited otherwise, the terms "coupled," "attached," and variations thereof herein are used broadly and encompass direct and indirect arrangements. The terms "a" and "an" herein do not denote a limitation of quantity, but rather denote the presence of at least one of the referenced items.

The present disclosure provides a vehicle maintenance platform with a lighting system. Examples of the vehicle maintenance platform may include, but are not limited, a creeper and a trolley. The lighting system is disposed on the vehicle maintenance platform. In an embodiment, the lighting system may be housed within a support frame of the platform. The lighting system has a plurality of light sources that illuminate a target region underneath a vehicle. The plurality of light sources of the lighting system is powered by a rechargeable power source.

Figure 1:
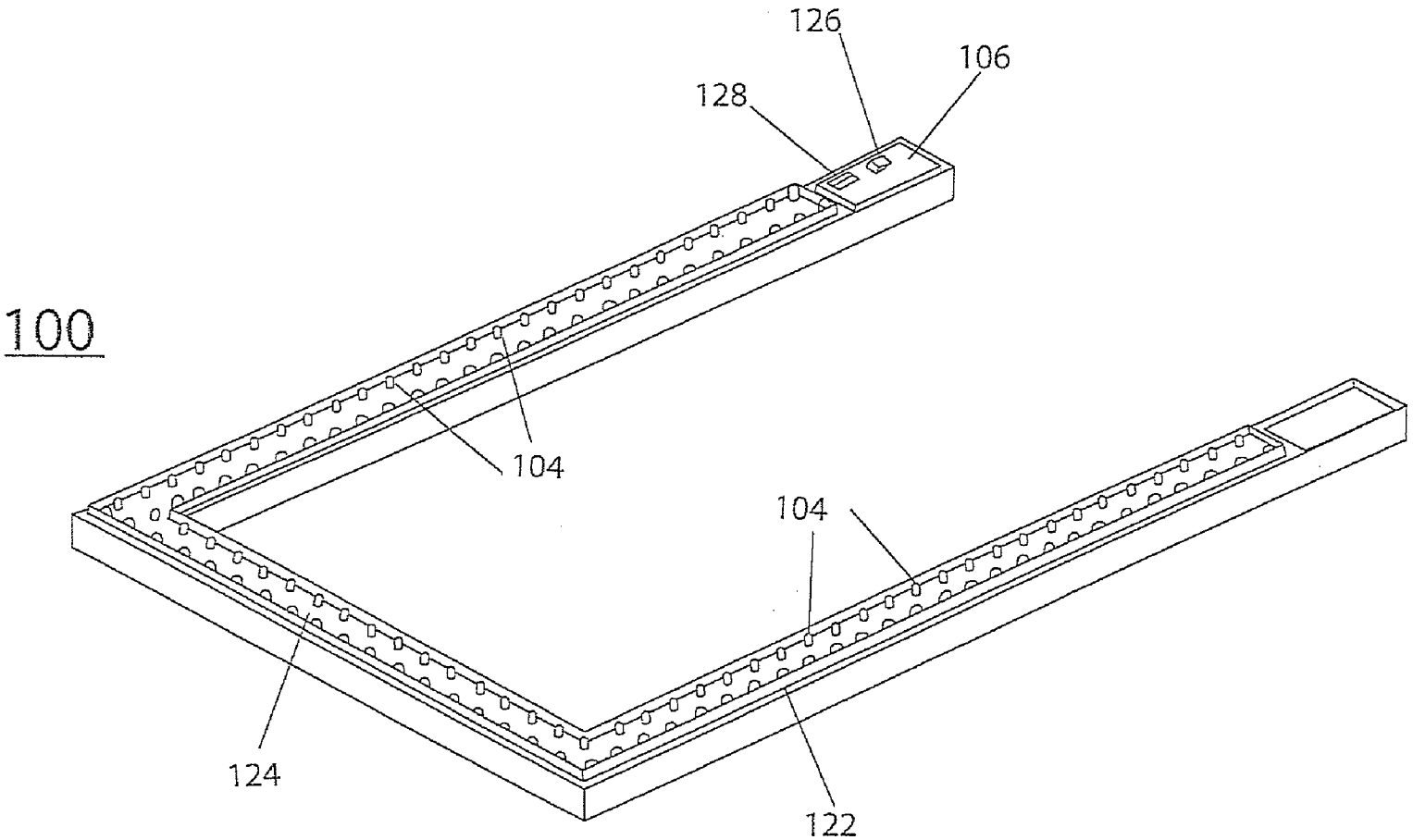
FIG. 1 illustrates a perspective view of the lighting system for the vehicle maintenance platform, in accordance with an embodiment of the present disclosure.

Referring to FIG. 1, an exemplary embodiment of a lighting system 100 for a vehicle maintenance platform is shown. The lighting system 100 includes a plurality of light sources 104 and a rechargeable power source 106 (hereinafter referred to as 'power source 106'). The lighting system 100 is integrated within the support frame structure 102 of the vehicle maintenance platform, such as a vehicle maintenance platform 150 (depicted in FIG. 2). Specifically, and as will be described in further detail below, in an embodiment, the light sources 104 may be disposed within a support frame structure 102 of a vehicle maintenance platform. The light sources 104 are configured to illuminate a target region underneath a vehicle. The power source 106 is housed within the frame structure 102 and is electrically connected to the light sources 104. The power source 106 provides electrical power to the light sources 104.

The lighting system 100 may include a lens arrangement 122 disposed over the light sources 104. The lens arrangement 122 focuses the light emitted from the light sources 104 onto the target region. The lens arrangement 122 includes a sheet 124 composed of at least one of a plastic material and a glass material, which is configured to focus the light emitted from the light sources 124 onto the target region. The lighting system may further comprise a power source 106, a switch 126, and a power supply port 128, which elements will be described in greater detail below.

Figure 2:
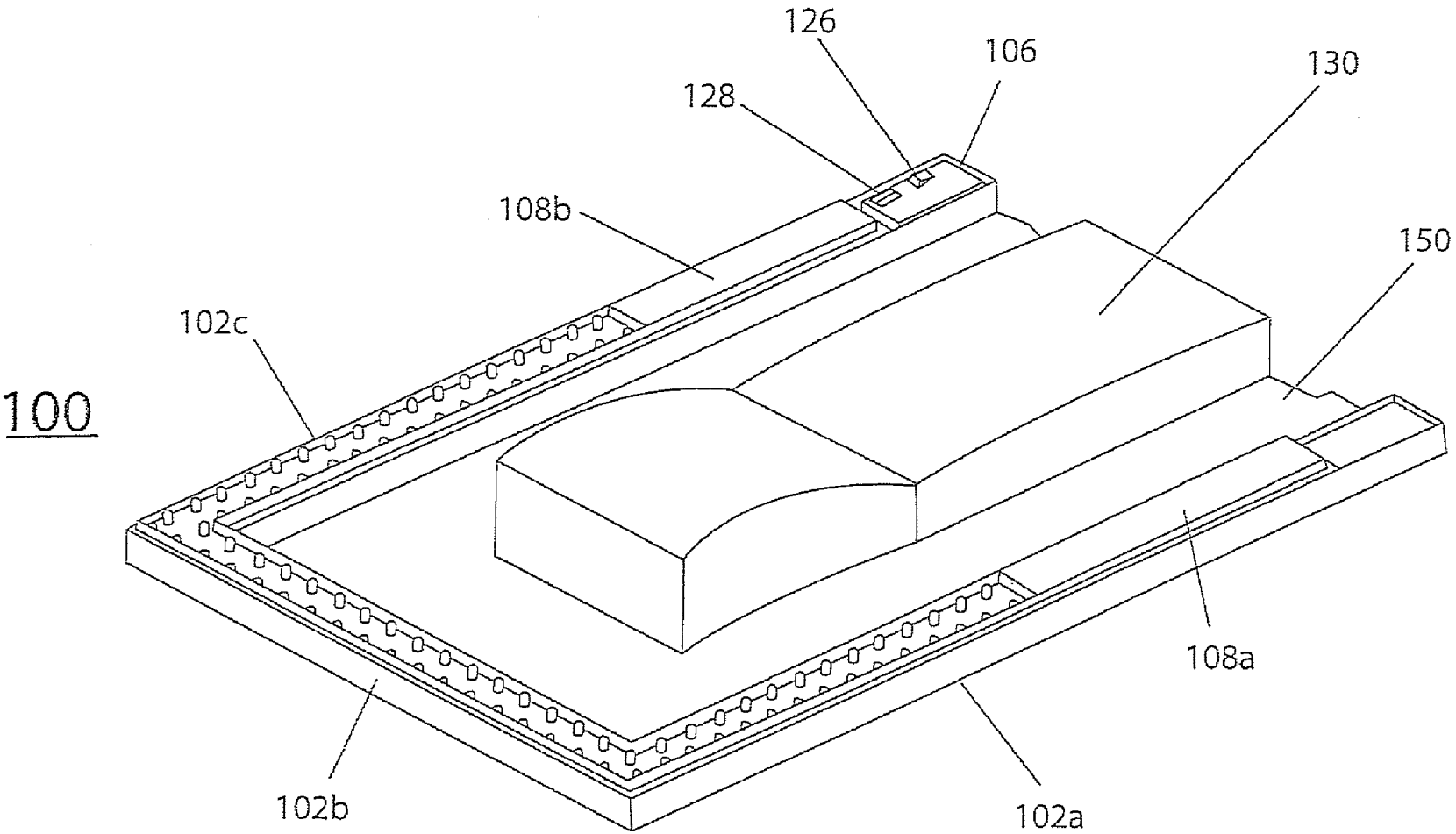
FIG. 2 illustrates a vehicle maintenance platform with a lighting system, in accordance with an embodiment of the present disclosure.

Referring now to FIG. 2, the support frame structure 102 of the vehicle maintenance platform 150 contains the lighting system 100 therewithin. In one embodiment of the present disclosure, the support frame structure comprises a plurality of steel channel sections 102*a*, 102*b*, and 102*c*, at least one section of which is capable of receiving the lighting system therein. The plurality of channel sections are oriented such that the open side of the sections is disposed upwardly and opposite the surface on which the platform is used. In this configuration, the open side of the steel channel sections allow light from the light sources to radiate upwardly from the surface on which the user is using the platform and onto the underside of a vehicle, under which a user will use the platform. In another embodiment, the support frame structure 102 may be formed from polyvinyl chloride (PVC) channel sections, or by any other material that is capable of being produced in channel form. In yet another embodiment, the support frame structure 102 may be formed from injection molded materials, an in a further embodiment, injection molded plastic, which embodiment will be described in further detail in connection with FIG. 3. The support frame structure 102 may further comprise a body support member 130, such as a cushion, disposed within the perimeter of the support frame structure, for providing comfort to a mechanic utilizing the platform 150.

Further, the light sources 104 are disposed in the support frame structure 102 in a serial manner. The light sources 104 are configured to illuminate the target region underneath the vehicle, which will be further described in conjunction with FIG. 4. As described above, the light sources 104 are arranged such that light emitted from the light sources 104 is projected towards the target region. In one embodiment of the present disclosure, to enhance focus of the projection of the light emitted from the light sources 104, the lens arrangement 122 of the lighting system 100 disposed over the light sources 104 focuses the light emitted from the light sources 104 onto the target region. The lens arrangement 122 includes a sheet 124 composed of at least one of a plastic material and a glass material, which is configured to focus the light emitted from the light sources 124 onto the target region. In an embodiment where the support frame structure is comprised of a plurality of channel sections, the sheet 124 may be disposed on the support frame structure such that it encloses at least a portion of the open side of a channel section of the support frame structure.

It would be apparent to a person skilled in the art that the sheet 124 may be composed of various other light transparent materials that focuses the light emitted from the light sources 104 onto the target region. The inclusion of the lens arrangement 122 reduces the luminance requirement of the light sources 104. This enables the lighting system 100 to include light sources 104 with relatively low luminance capacities, which in turn helps in minimizing the power requirements of the light sources 104.

In one embodiment of the present disclosure, the light sources 104 may be Light Emitting Diodes (LEDs). An LED is a preferred choice for a light source 104, as LED consumes comparatively less electrical energy as compared to other light sources. This effectively reduces electrical power requirement of the power source 106 of the lighting system 100. However, it may be apparent to a person skilled in the art that various other light sources may be utilized as the light sources 104. The light sources 104 are supplied with the electrical power from the power source 106.

In an embodiment, the power source 106 is housed within the frame structure 102. Specifically, the power source 106 is housed within a bottom portion of the frame structure 102 (as depicted in FIG. 1). However, it may be apparent to a person skilled in the art that the power source 106 may be housed in or disposed at various other positions of the frame structure 102. The power source 106 is electrically connected to the light sources 104 through an internal wiring (not shown). The power source 106 supplies the electrical power to the light sources 104 so that the light sources 104 emit the light for illuminating the target region. Further, lighting system 100 includes an electrical switch 126 configured to activate and deactivate the light sources 104. Specifically, when the electrical switch 126 is in an 'ON' state, the power source 106 and light sources 104 are electrically connected and the light sources 104 are powered on. Further, when the electrical switch 126 is in an 'OFF' state, the power source 106 and the light sources 104 are disconnected, thereby powering-off the light sources 104.

Examples of the power source 106 may include, but are not limited to, a Nickel Cadmium (NiCd) Battery, a Nickel-Metal Hydride (NiMH) Battery, and a Lithium-ion Battery. In one embodiment of the present disclosure, the power source 106 may have a voltage of about 9.6 volts. However, it may be apparent to a person skilled in the art that batteries with different voltage may also be utilized as the power source 106. Further, the power source 106 may be recharged to a desired voltage level when required. The power source 106 may be connected to an external power source such as a wall socket through a power supply port 128, for charging to the power source 106 to the desired voltage level. In an embodiment where the power source 106 is contained within the support frame structure 102, the support frame structure 102 may include a requisite aperture to permit the power source 106 and power supply port 128 to connect to the external power supply.

Figure 3:
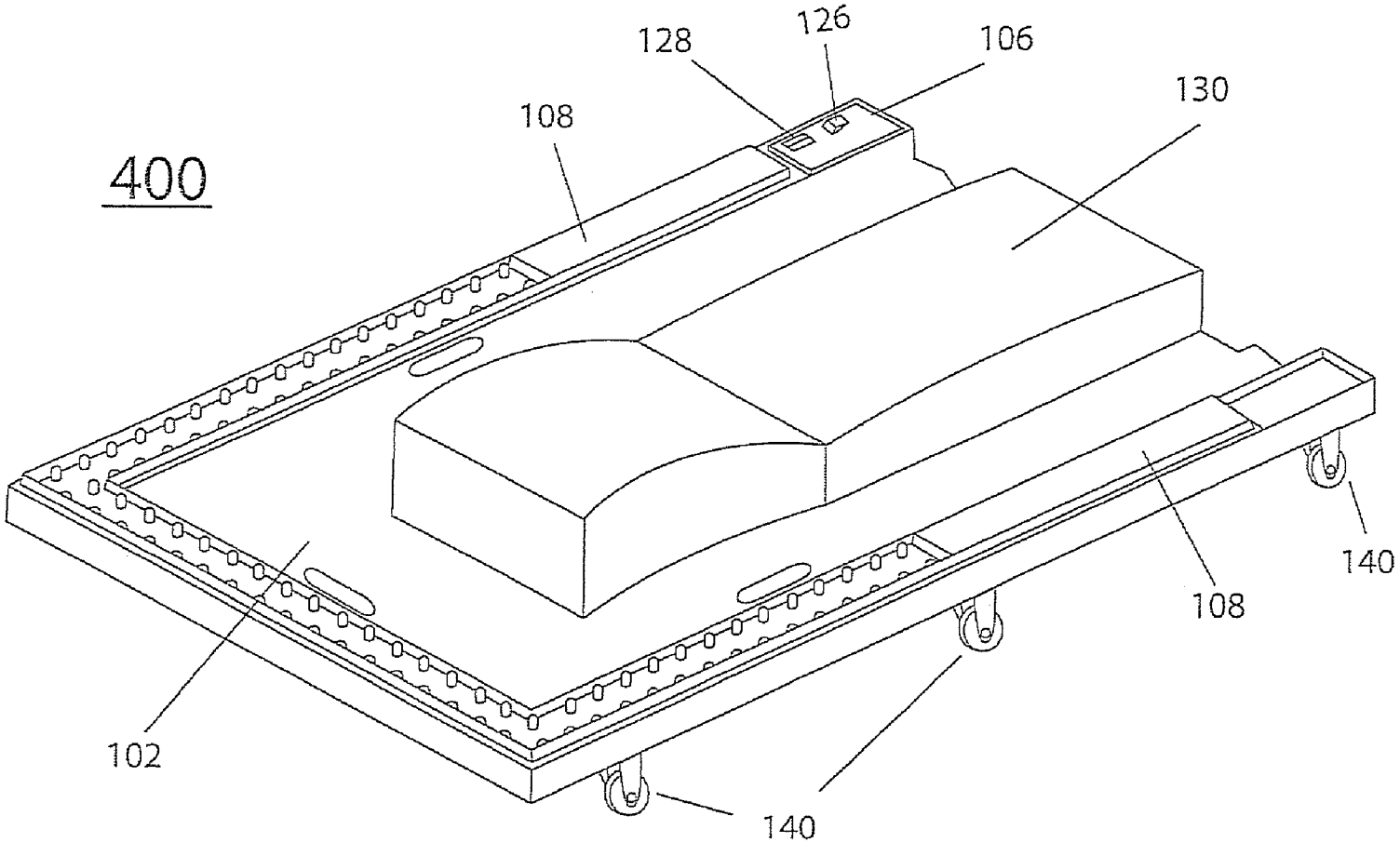
FIG. 3 illustrates a vehicle maintenance apparatus with a lighting system, in accordance with an embodiment of the present disclosure.

In an embodiment, the support frame structure 102 is formed in a bent shape (not shown), which shape circumscribes a portion of the maintenance platform 150. In another embodiment of the present disclosure, the support frame structure 102 is formed in an open-ended rectangular configuration (as depicted in FIGS. 2 and 3). The frame structure 102 may have other shapes, which shapes may circumscribe or otherwise correspond to the shape of the maintenance platform 150. At least a portion of frame structure may not house the lighting system, which portion 108 may be comprised of a magnetic material, such that a surface portion of the frame structure is magnetized, and such that a mechanic may store ferromagnetic tools and components securely and proximately on that portion of the frame structure while using the platform. Usage of the lighting system 100 with the maintenance platform 150 is further described in conjunction with FIG. 4.

Referring now to FIG. 3, a vehicle maintenance apparatus 400 is shown, in accordance with another embodiment of the present disclosure. The vehicle maintenance apparatus 400 includes a support frame structure 102, a vehicle maintenance platform 150 and a lighting system 100 housed within the support frame structure of the vehicle maintenance platform 150. In this embodiment, the support frame structure 102 is formed from injection molded material, and in a further embodiment, injection molded plastic. It will be apparent to one skilled in the art that the injection molding process that forms the support frame structure allows the support frame structure of the present embodiment to be contoured for ergonomic purposes. It will further be apparent that the support frame structure of the apparatus may be formed from the channel sections described in conjunction with FIG. 2, or from any other material that can be configured to house the lighting system 100 therewithin.

The support frame structure 102, when formed from injection molded plastic, will a contain requisite depression or channel at a periphery thereof for receiving the lighting system 100. The support frame structure 102 may further comprise at least one section 108 of magnetic material removably or permanently attached to the support frame structure, which at least one section 108 will facilitate a mechanic in storing ferromagnetic tools and components securely and proximately on that portion of the frame structure while using the platform 150 or the apparatus 400. A power source 106 is housed within the frame structure 102 and is electrically connected to the light sources 104 of the lighting system 100 to provide electrical power to the light sources 104. The frame structure 102 of the apparatus 400 will further contain a switch 126 and a power supply port 128 operatively coupled with the power source 106, which switch, port, and power source will operate in conjunction with the lighting system in the manner described in connection with FIG. 2.

Further, wheels 140 are coupled to a bottom portion of the support structure 102. The wheels 140 are configured to facilitate rolling of the support frame structure 102 on a surface such as the ground, thereby enabling movement of the vehicle maintenance apparatus 400 on the ground. Further, a body support member 130 may disposed on the support frame structure 102. More specifically, the body support member 130 may be disposed within the perimeter of the support frame structure 102. The body support member 130 is configured such that a mechanic may lie thereon, while performing various maintenance activities in and around the bottom portion of a vehicle.

Figure 4:
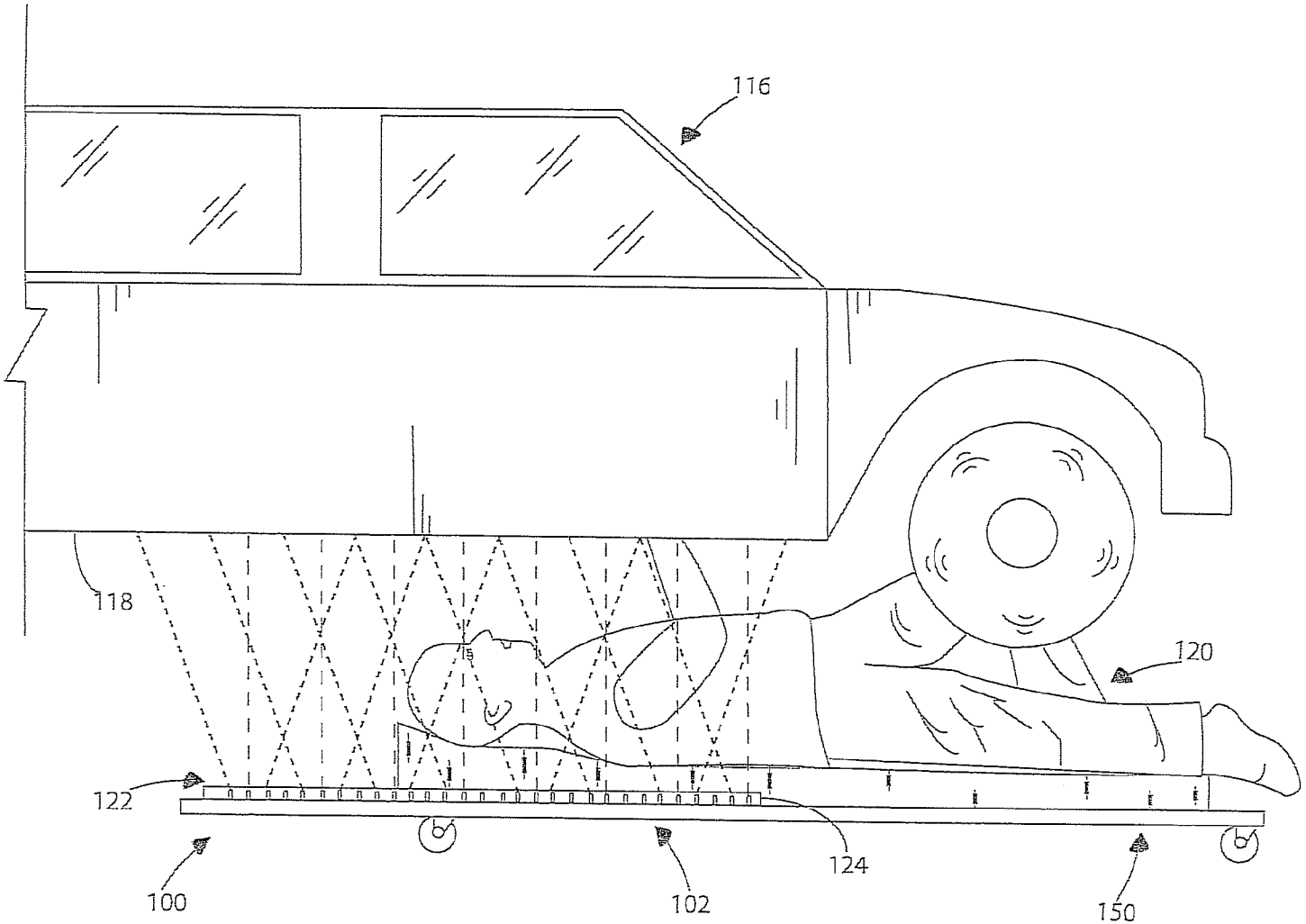
FIG. 4 illustrates an environment depicting use of a vehicle maintenance apparatus, in accordance with an embodiment of the present disclosure.

Referring now to FIG. 4, an environment depicting usage of the maintenance platform 150 and lighting system 100 is illustrated, in accordance with one embodiment of the present disclosure. The maintenance platform 150 containing the lighting system 150 may be slid by a mechanic 120 underneath a vehicle 116. More specifically, the lighting system 100 of the maintenance platform 150 may be slid close to a target region in a bottom portion 118 of the vehicle 116, where maintenance is required. The light sources 104 of the lighting system 100 may be utilized to illuminate the target region of the bottom portion 118. The illumination of the target region allows the mechanic 120 to perform various maintenance activities thereon.

A vehicle maintenance platform with lighting system, such as the lighting system 100, and a vehicle maintenance apparatus such as the vehicle maintenance apparatus 400 are advantageous in illuminating a region, such as a bottom portion of a vehicle. The lighting system 100 of the platform and apparatus does not require electrical power from an external wall socket to operate. The lighting system generates the electrical power on-board. This enables the lighting system 100 to be utilized in places with limited or no access to external electrical ports, such as a driveway or a junkyard. Furthermore, the lighting system 100 increases the efficiency of the mechanic while also providing convenience in his or her performing maintenance activities. The lighting system 100 is especially useful for a mechanic that often needs to access the bottom portion of the vehicle for maintenance activities.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present disclosure.

What is claimed is:

1. A lighting system for a vehicle maintenance platform, the vehicle maintenance platform useable for maintenance activities underneath a vehicle:

wherein the vehicle maintenance platform comprises a support structure, said support structure having at least three sides, a plurality of wheels attached to the support structure for rolling the support structure on a surface, and a body support member disposed on the support structure to allow a mechanic to lie thereon, and wherein the lighting system comprises a frame structure comprising at least three walls, the walls forming a continuous channel that extends along the entire frame structure a plurality of light sources disposed within the channel the plurality of light sources arranged in at least three linear arrays, and the at least three sides of the support structure having a linear array adjacent thereto, the plurality of light sources configured to illuminate a target region underneath the vehicle; and a rechargeable power source electrically connected to the plurality of light sources, the rechargeable power source capable of providing electrical power to the plurality of light sources, wherein the plurality of light sources is capable of emitting light to illuminate a target region underneath the vehicle, and a lens arrangement disposed over the channel, wherein the lens arrangement is configured to focus light emitted from the plurality of light sources onto the target region.

2. The lighting system of claim 1, wherein the lens arrangement comprises a sheet composed of at least one of a plastic material and a glass material.

3. The lighting system of claim 1, further comprising an electrical switch configured to control the supply of the electrical power from the rechargeable power source to the plurality of light sources.

4. The lighting system of claim 1, further comprising a power supply port configured to charge the rechargeable power source from an external power source.

5. The lighting system of claim 1, wherein the plurality of light sources are Light Emitting Diodes (LED).

6. The lighting system of claim 1, wherein the rechargeable power source is housed within the frame structure.

7. The lighting system of claim 1, wherein the support structure comprises a plurality of channel sections, in which sections at least one light source of the plurality of light sources may be disposed.

8. The lighting system of claim 1, wherein the support structure comprises injection molded material.

9. A vehicle maintenance apparatus, comprising:

a vehicle maintenance platform comprising a support structure, said support structure having at least three sides, a plurality of wheels attached to the support frame structure for rolling the support frame structure on a surface, and a body support member disposed on the support structure to allow a mechanic to lie thereon; and a lighting system operatively coupled to the vehicle maintenance platform, the lighting system comprising:

a frame structure comprising at least three walls, the walls forming a continuous channel that extends along the entire frame structure, a plurality of light sources disposed within the channel, the plurality of light sources arranged in at least three linear arrays, and the at least three sides of the support structure having a linear array of the at least three linear arrays placed directly adjacent, the plurality of light sources configured to illuminate a target region underneath a vehicle, and a rechargeable power source electrically connected to the plurality of light sources, the rechargeable power source capable of providing electrical power to the plurality of light sources, wherein the plurality of light sources is capable of emitting light to illuminate a target region underneath the vehicle while maintenance activities thereof, and a lens arrangement disposed over the channel, wherein the lens arrangement is configured to focus light emitted from the plurality of light sources onto the target region.

10. The vehicle maintenance apparatus of claim 9, wherein the lighting system is housed within the support structure.

11. The vehicle maintenance apparatus of claim 9, wherein the lens arrangement comprises a sheet composed of at least one of a plastic material and a glass material.

12. The vehicle maintenance apparatus of claim 9, further comprising an electrical switch configured to control supply of the electrical power from the rechargeable power source to the plurality of light sources.

13. The vehicle maintenance apparatus of claim 9, wherein the vehicle maintenance platform further comprises a power supply port configured to charge the rechargeable power source from an external power source.

14. The vehicle maintenance apparatus of claim 9, wherein the plurality of light sources are Light Emitting Diodes (LED).

15. The vehicle maintenance apparatus of claim 9, wherein the support frame structure comprises a plurality of channel sections, in which sections at least one light source of the plurality of light sources may be disposed.

16. The vehicle maintenance apparatus of claim 9, wherein the support structure comprises injection molded material.

* * * * *